US005549241A

United States Patent [19]

Correll

[11] Patent Number: 5,549,241

[45] Date of Patent: Aug. 27, 1996

[54] INTERLOCK FOR STACKABLE BOXES

[76] Inventor: John D. Correll, 8459 Holly Dr., Canton, Mich. 48187

[21] Appl. No.: 273,369

[22] Filed: Jul. 11, 1994

Related U.S. Application Data

[63] Continuation of Ser. No. 94,526, Jul. 20, 1993.

[51] Int. Cl.[6] ..... B65D 5/32

[52] U.S. Cl. ..... 229/120.01; 229/195; 229/915

[58] Field of Search ..... 229/915, DIG. 11, 229/120.32, 120.01, 120.08, 120.21, 195, 198.2; 206/501, 512

[56] References Cited

U.S. PATENT DOCUMENTS

| | | | |
|---|---|---|---|
| 2,634,899 | 4/1953 | Meller | 229/195 |
| 3,006,523 | 10/1961 | Keith | 229/120.32 X |
| 3,537,956 | 11/1970 | Falcone et al. | 220/315 X |
| 3,623,650 | 11/1971 | Watts | 229/DIG. 11 |
| 4,245,773 | 1/1981 | Stollberg | 229/DIG. 11 |
| 4,298,157 | 11/1981 | De Vierno | 229/195 X |
| 4,944,452 | 7/1990 | Kent et al. . | |
| 4,971,242 | 11/1990 | LaNicca . | |
| 4,984,734 | 1/1991 | Zion et al. | 229/915 X |
| 4,993,625 | 2/1991 | Stease et al. . | |
| 5,002,224 | 3/1991 | Muise | 229/918 X |
| 5,020,717 | 6/1991 | Cassidy | 229/197 X |
| 5,029,714 | 7/1991 | Cassidy | 229/195 X |
| 5,381,949 | 1/1995 | Correll | 229/195 X |

FOREIGN PATENT DOCUMENTS

| | | | |
|---|---|---|---|
| 591369 | 9/1977 | Switzerland | 229/195 |

*Primary Examiner*—Allan N. Shoap
*Assistant Examiner*—Christopher J. McDonald

[57] ABSTRACT

An interlock is disclosed for stackable lower and upper boxes. The lower box is provided with upstanding hook-shaped tabs extending upwardly from parallel walls and the upper box is provided with slots in the bottom which register with the tabs when the upper box is laterally offset from the lower box. After the tabs are inserted into the slots, the boxes are shifted laterally into alignment with each other and the hook-shaped tabs overlap the bottom of the upper box. Box blanks are disclosed for making the upper and lower boxes with the interlock tabs positioned so that the box blanks can be nested for saving material. A corner interlock is disclosed for latching the interlock tab in the locked position.

9 Claims, 3 Drawing Sheets

INTERLOCK FOR STACKABLE BOXES

This application is a continuation, of application Ser. No. 08/094,526, filed Jul. 20, 1993.

FIELD OF THE INVENTION

This invention relates to boxes; more particularly, it relates to stackable boxes which are especially adapted for pizza and other foods.

This application discloses and claims a corner interlock structure which is related to a structure claimed in copending application Ser. No. 08/069,830 filed by John D. Correll on Jun. 1, 1993.

BACKGROUND OF THE INVENTION

In the pizza retail industry, it is common practice to sell two pizza pies together for delivery or take-out. Although the two pizza pies sold together might be separately packaged, one common merchandising practice is to deliver the two to the customer in a single container. A single container used by one well known chain of pizzerias is an elongated tray with the two pizza pies disposed side-by-side with a bag over the tray. A tray of this type is described in the patent to Stease et al. U.S. Pat. No. 4,993,625 granted Feb. 19, 1991.

It is also known in the prior art to package two pizza pies in a composite box which provides a separate compartment for each of the pizza pies, one above the other. This has been proposed in a composite box which comprises two stackable boxes wherein a lower open-top box is adapted to receive one pizza pie and an upper box stacked on the lower one, is adapted to receive a second pizza pie. In this arrangement, the upper box is connected with the lower box for convenience in handling and the bottom of the upper box serves as a cover for the open-top lower box. A packaging arrangement of this kind is disclosed in the Zion et al. U.S. Pat. No. 4,984,734 granted Jan. 15, 1991. A similar arrangement is described in the LaNicca U.S. Pat. No. 4,971,242 granted Nov. 20, 1990. In another arrangement, a composite box is made by folding a one-piece box blank to provide a box having a lower compartment with a bottom panel for receiving one pizza pie, and an upper compartment having a bottom panel for receiving a second pizza pie. The upper compartment is provided with a hinged cover. A box of this construction is disclosed in the Kent et al. U.S. Pat. No. 4,944,452 granted Jul. 31, 1990.

The cost of a container for delivery and carry-out pizza amounts to a substantial part of the total cost of the product. There is a continuing need in the industry for reduction in the cost of a pizza box which will meet required performance standards. One approach to achieving cost reduction for pizza boxes is to provide a suitable box design which requires a reduced amount of board for making the box blank. In the case of packaging two pizza pies together, the use of stackable boxes such as those prior art boxes described above affords the advantage of reducing the amount of board required by eliminating the need for a separate cover over the lower box. While this is a meritorious cost savings feature, a successful box of this type must be implemented in such a manner that it provides desired performance characteristics.

In stacked boxes for containing two pizza pies in an "over-under" arrangement, special care must be taken for protection of the product. The boxes must exhibit a high degree of rigidity and strength and properly enclose the product. When the boxes are held by one hand at any corner, there should be no relative movement between the boxes and no drooping or other deformation of either box. Further, each of the stacked boxes must lend itself to fast set-up time and fast take-down time. The two stackable boxes, after each receives a pizza pie, must be adapted for easy and quick stacking with an interlock arrangement to provide a rigid connection between the boxes.

A general object of this invention is to provide stackable boxes, especially adapted for the pizza pies, which overcomes certain disadvantages of the prior art.

SUMMARY OF THE INVENTION

In accordance with this invention, a pair of stackable boxes are interlocked to provide a box structure with upper and lower compartments. The lower box is topless and the bottom of the upper box serves as a cover for the lower compartment. The interlock is accomplished by providing upstanding interlock tabs on the upper edges of parallel walls of the lower box and mating slots in the bottom of the upper box. The interlock tabs are hook-shaped and register with the slots when the boxes are laterally offset from each other. After the tabs are inserted, the boxes are shifted laterally into alignment to engage the hooks with the bottom of the upper box.

Further, in accordance with this invention, the lower boxes are provided with the interlock tabs at such locations on the walls so that box blanks may be nested together in side-by-side relation with the orientation of one blank being one hundred eighty degrees from the orientation of the other blank.

Further, in accordance with the invention, an improved corner interlock structure is provided in which a corner interlock tab on ends of a wall extends through a shaped opening in the adjacent wall and a gate member is provided to latch the interlock tab in the locking position.

A complete understanding of this invention may be obtained from the detailed description that follows taken with the accompanying drawings.

BEST MODE FOR CARRYING OUT THE INVENTION

Figure 1:
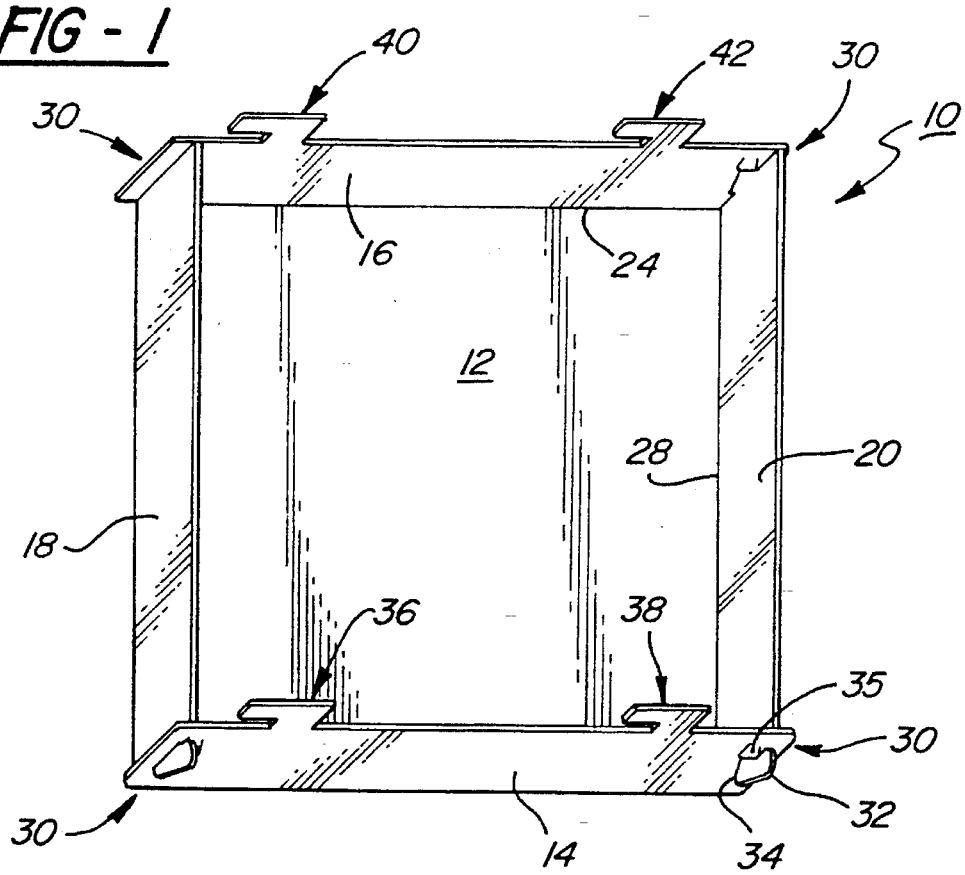
FIG. 1 is a perspective view of the lower box of the stackable boxes according to this invention.
Figure 2:
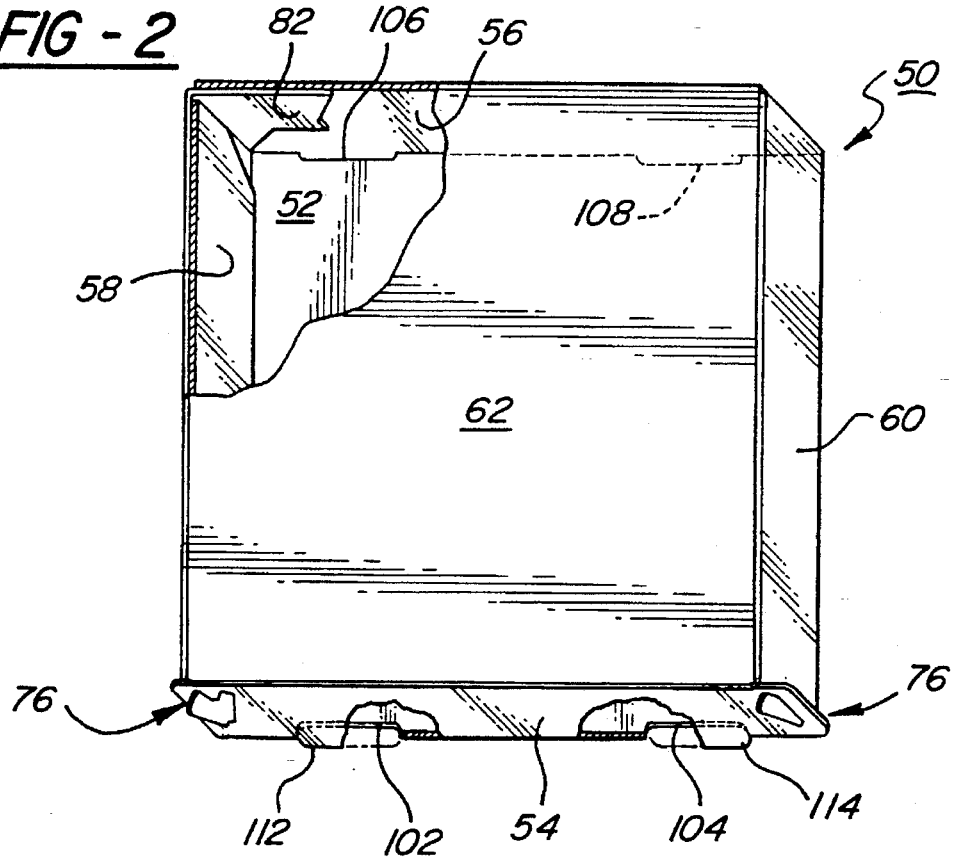
FIG. 2 is a perspective view of the upper box of the stackable boxes.

Referring now to the drawings, there is shown an illustrative embodiment of this invention in a pair of rectangular stackable boxes each of which is adapted to receive a pizza pie. It will be appreciated as the description proceeds that the invention is useful for other applications and may be realized in different embodiments.

General Description

Figure 3:
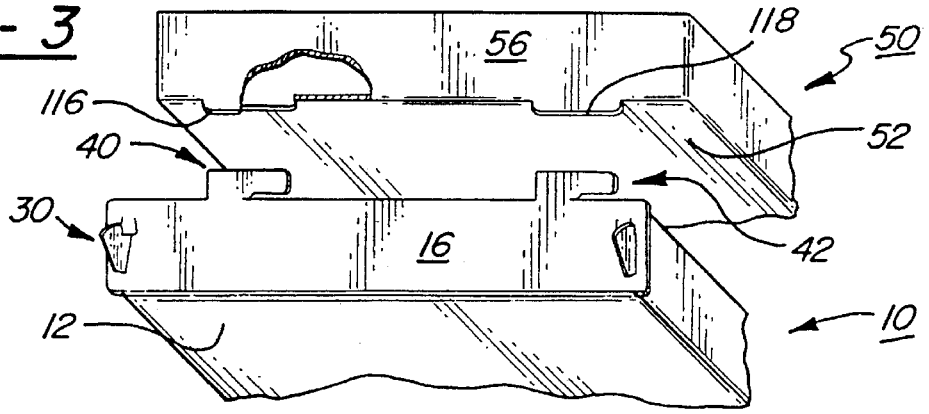
FIG. 3 is a perspective view showing the upper and lower boxes from the rear being moved into interlocking engagement.
Figure 4:
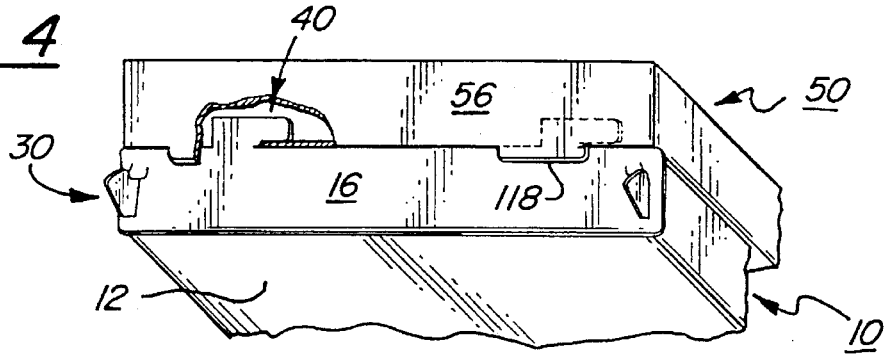
FIG. 4 is a perspective view from the rear showing the upper and lower boxes interlocked.
Figure 5:
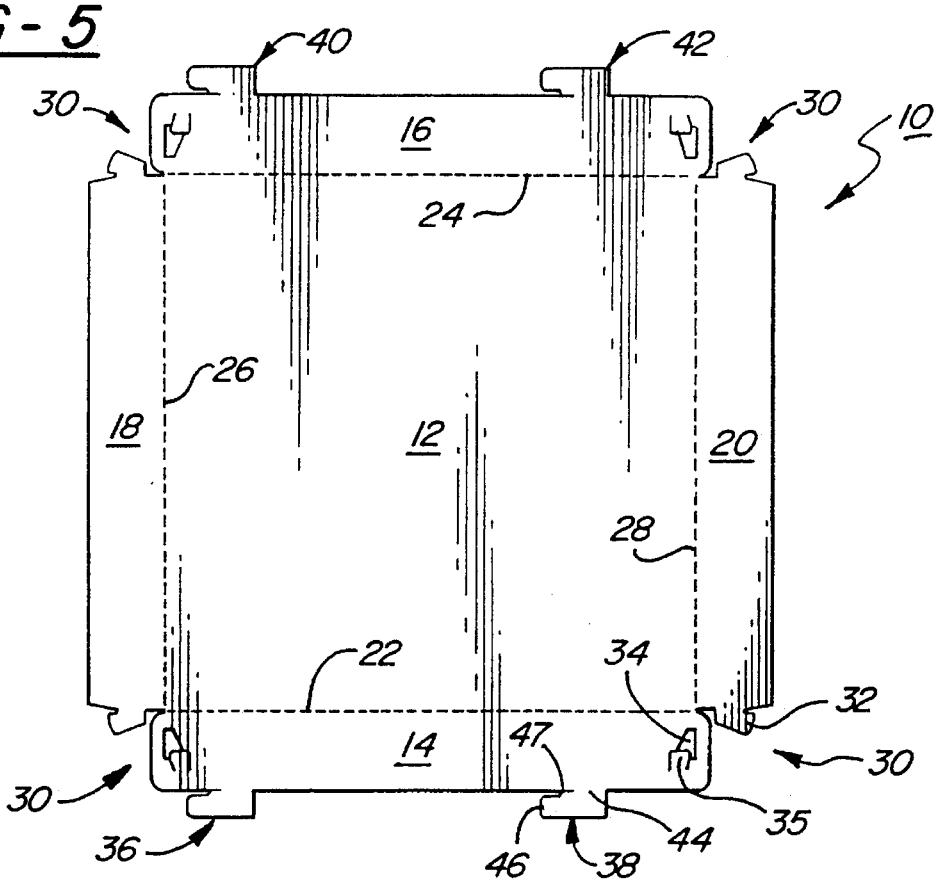
FIG. 5 is a plan view of the box blank for making the lower box.
Figure 6:
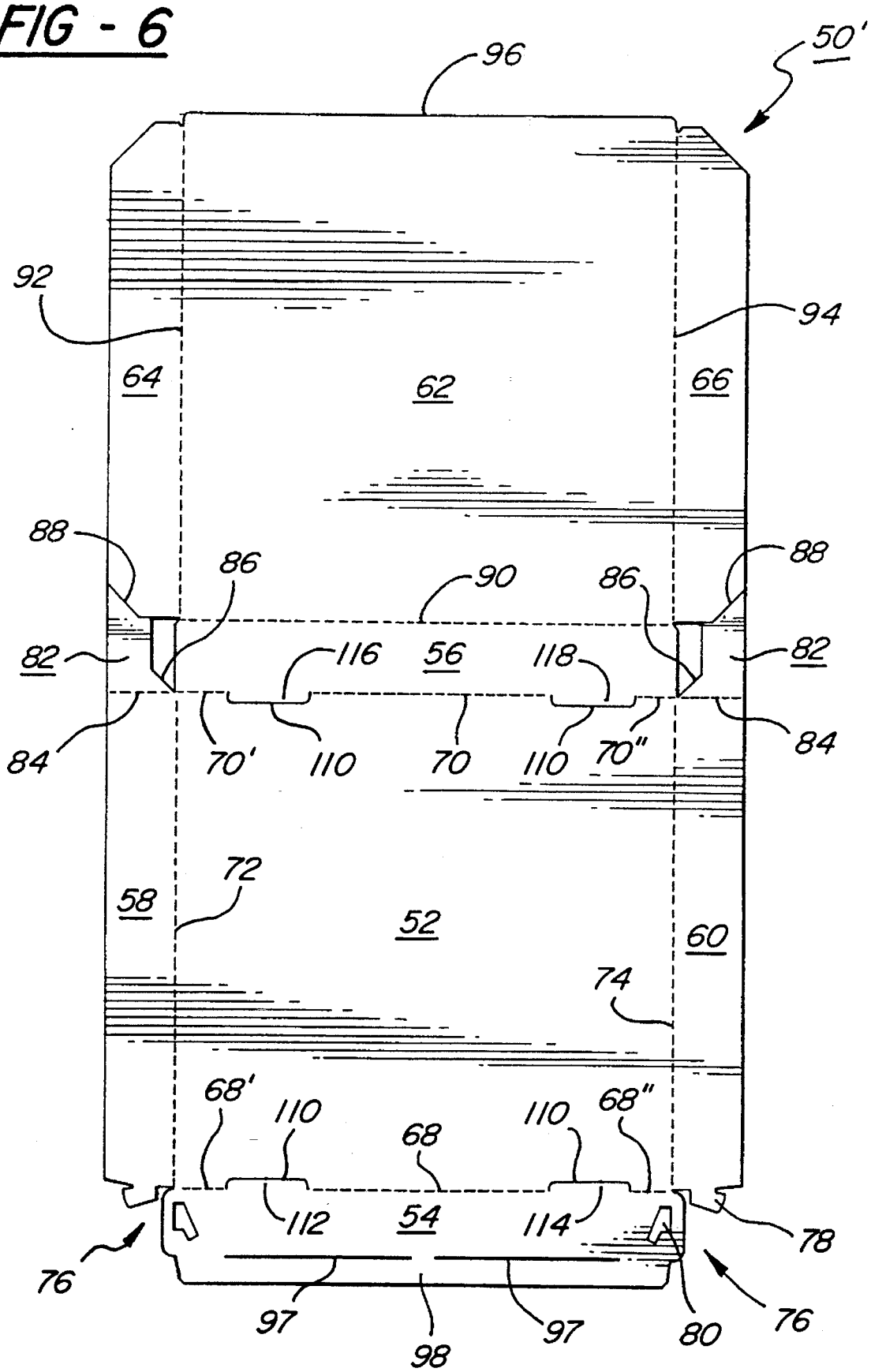
FIG. 6 is a plan view of the box blank for making the upper box.

The stackable boxes of this invention are shown in FIGS. 1 through 4 and are made from box blanks which are shown in FIGS. 5 and 6. A pair of stackable boxes will be described which provide two separate compartments each of which is adapted to contain a pizza pie or other food product. The lower stackable box 10 shown in FIG. 1 is a topless box and thus requires a minimized amount of material for construction. The upper box 50, shown in FIG. 2, serves as a top or cover for the lower box and is provided with an integral lid. Each of the boxes may be erected by folding a flat box blank. A pizza pie is placed in the compartment of each box before the boxes are stacked; the pie may be cut previously or, as is the practice of some pizzerias, the pie may be cut in the box prior to folding the side walls of the box. The boxes are stacked and interlocked with each other for delivery of the product to the customer. The upper box is opened by raising the lid and the lower box is opened by removing the upper box. The structure and features of the upper and lower boxes will now be described in detail.

The Lower Box

The lower box 10 will now be described with reference to FIG. 1 and with reference also to FIG. 5 which shows the box blank 10' from which the box is made. The box 10, in general, comprises a bottom panel 12 of rectangular shape, front and rear walls 14 and 16 and left and right side walls 18 and 20, respectively. The bottom panel 12 terminates at its front edge in a fold line 22 and is hingedly connected thereby with the front wall 14. The bottom panel 12 terminates at its rear edge in a fold line 24 and is hingedly connected thereby with the rear wall 16. Similarly, the bottom panel 12 terminates at its left and right edges in fold lines 26 and 28, respectively, and is hingedly connected thereby with the left and right side walls, respectively. Each of the corners of the lower box, formed at the intersection of adjoining walls, is provided with a corner interlock 30 to hold the walls together. Each corner interlock 30 comprises a lobe-shape tab 32 extending from the end of the side wall and a shaped opening 34 of special configuration in the front and rear walls adapted including a hinged gate member 35 to coact with the tab 32.

According to this invention, a pair of box interlock tabs 36 and 38 extend upwardly from the top edge of the front wall 14 and are unitary therewith. Similarly, a pair of box interlock tabs 40 and 42 extend upwardly from and are unitary with the rear wall 16. All of the box interlock tabs are of the same size and shape and each comprises a body portion 44 and a hook portion 46 extending to the left from the body portion and spaced by a notch from the upper edge of the wall. A slit 47 extends from the bottom of the notch into the body portion of the tab. The function of the box interlock tabs will be described in detail below.

The lower box 10 is constructed from the box blank 10' by folding the blank in the following manner. First, the side walls 18 and 20 are folded upwardly from the bottom panel 12 along the fold lines 26 and 28 and held in position while the front wall 14 is along fold line 22 to the upright position; then, the front and side walls are positioned so that the corner tabs 32 are insertable into the respective openings 34. For this, each side wall is folded so it is tilted approximately parallel to the diagonal edge of opening 34 with the front wall upright. Insertion of the tab pushes the gate member 35 open and when the side wall is released it springs back to a position in which the tab engages the vertical wall of the opening. Then the gate member 35 moves to its closed position and blocks movement of the tab to an unlocking position. The front and side walls are held approximately perpendicular to the bottom panel. Finally, the rear wall 16 is folded to the upright position and interlocked with the side walls in the same manner as the front wall.

With the lower box 10 erected as described and shown in FIG. 1, it is ready for use. It is noted that the front wall 14 is provided with upstanding box interlock tabs 36 and 38 and the rear wall 16 is provided with upstanding box interlock tabs 40 and 42. The operation of these tabs for interlocking the lower box 10 with the upper box 50 will be explained after the upper box is described.

The Upper Box

In accordance with this invention, the upper box 50 differs from the lower box 10 in that 1) box interlock slots are provided, 2) a lid is added, 3) the rear corners are of different construction, and 4) the box interlock tabs are omitted. The distinctive structure and features of the upper box 50 will now be described with reference to FIGS. 2 and 6.

The box 50, in general, comprises a bottom panel 52 of rectangular shape, front and rear walls 54 and 56 and left and right side walls 58 and 60, respectively, and a lid 62 with left and right side flaps 64 and 66. The bottom panel 52 terminates at its front edge in an interrupted fold line 68, 68' and 68" and is hingedly connected thereby with the front wall 54. The bottom panel 52 terminates at its rear edge in an interrupted fold line 70, 70' and 70" and is hingedly connected thereby with the rear wall 56. Similarly, the bottom panel 52 terminates at its left and right edges in fold lines 72 and 74, respectively, and is hingedly connected thereby with the left and right side walls, respectively.

Each of the front corners of the upper box, formed at the intersection of adjoining walls, is provided with a corner interlock 76 to releasably hold the walls together. Each corner interlock 76 comprises a lobe-shaped tab 78 extending from the end of the side wall and a shaped opening 80 of special configuration adapted to coact with the tab 78. The corner interlocks 76 are the same as interlocks 30 except that the gate member is omitted.

Each of the rear corners of the upper box, formed at the intersection of adjoining walls, is provided with a corner flap 82. Each flap 82 is hingedly connected by a fold line 84 with the rear edge of the respective side wall. The upper edge of the flap is aligned with the upper edge of the respective side wall and the lower edge is provided with a clearance notch 86 as will be described subsequently. As noted in FIG. 6, the corner flap 82 has a free end 88 which is severed from the respective side flap of the lid 62.

The lid 62 terminates at its rear edge in a fold line 90 and is hingedly connected thereby with the upper edge of the rear wall 56. The lid 62 terminates at its left and right edges in fold lines 92 and 94 respectively, which hingedly connect the flaps 64 and 66 to the lid. The lid has a free front edge 96.

The front wall 54 terminates at a fold line 97 and a flap or ledge 98 is hingedly connected with the front wall at the fold line.

According to this invention, a pair of spaced box interlock slots 102 and 104 (see FIG. 2) are disposed at the front edge of the bottom panel 52. Similarly, a pair of spaced interlock slots 106 and 108 are disposed at the rear edge of the bottom panel 52. As shown in FIG. 6, the inner edge and ends of each of the slots is formed in the bottom panel 52 by a slit 110. In the case of slot 102, the slit 110 extends from the left end of fold line 68 to the right end of fold line 68'. Similarly, in the case of slot 104 the slit 110 extends from the right end of fold line 68 to the left end of fold line 68". The slots 106 and 108 at the rear edge of bottom panel 52 are similarly formed with reference to fold line 70, 70' and 70". This construction provides index or guide tabs 112 and 114 adjacent slots 102 and 104, respectively, which extend downwardly from the front wall 54 and define the outer edges of the slots. In a similar manner, guide tabs 116 and 118 are provided adjacent the slots 106 and 108 which extend downwardly from the rear wall 56 and form the outer edges of the slots.

The upper box 50 is constructed from the box blank 50' by folding the blank in the following manner. The side walls 58 and 60 and the front wall 54 are folded upwardly from the bottom panel along the fold lines 72, 74 and 68, respectively, and the corner interlocks 76 are engaged in the same manner as described with reference to the lower box. Additionally, the ledge 98 is folded inwardly along the fold line 97 to a position approximately parallel with the bottom panel 52. Next, the corner flaps 82 are folded inwardly along the fold lines 84 and the rear wall 56 is folded to an upright position along the fold line 70. Then, the lid 62 is folded forwardly along the fold line 90 and simultaneously the side flaps 64 and 66 are folded inwardly to a position approximately perpendicular to the lid. When the lid 62 is closed, the flaps 64 and 66 are disposed inside the walls 58 and 60, respectively, and the front edge 96 of the lid rests on the ledge 98. It is noted that the guide tabs 112, 114, 116 and 118 extend downwardly below the bottom panel with the front and rear walls in the upright position.

The Box Blanks

The box blank 10' and 50' as shown in FIG. 5 and 6, are cut from a flat sheet of fibreboard material, preferably corrugated board. In the illustrations of the box blanks, an interrupted line with long dashes represents a fold line created by spaced slits through the board. A solid line represents a separation of the board formed by a slit through the board. Any method of forming a fold line in the box material may be herein referred to as scoring of the board. The methods of forming the fold lines as described herein are presently preferred but it will be appreciated that any other method known to those skilled in the art may be used for any of the fold lines. In summary, as referred to herein, a fold line is any line between two points on the board along which the board is intended to be folded when the blank is being erected into a box or when the box is being used as a container.

Location of Interlock Tabs and Slots

It is noted that the front slots 102 and 104 and the rear slots 106 and 108 are located on the bottom panel 52 of the upper box 50 so that they register, respectively, with the front box interlock tabs 36 and 38 and the rear interlock tabs 40 and 42, respectively. The respective slots and tabs are located relative to each other so that the tabs may enter the slots without interference when the upper box is placed on top of the lower box. The interlocking of the boxes will be described subsequently.

It is noted that the front interlock tabs 36 and 38 and the rear interlock tabs 40 and 42 are located non-symmetrically with reference to the front-to-rear center line of the lower box 10, i.e. the left tabs 36 and 40 are closer to the left side wall 18 than the right tabs 38 and 42 are to the right side wall 20. More particularly, the left tabs on the front and rear walls are located inwardly from the left end of the front and rear walls, respectively, by an offset distance which is greater than the width of the tabs, and the right hand tabs are offset inwardly from the right end of the front and rear walls, respectively, by a second offset distance which is greater than twice the width of the tabs. This placement of the tabs, in accordance with this invention, serves to permit a pair of box blanks 10' to be nested together for cutting from a single board with a savings of material. In this nesting arrangement two box blanks 10' are disposed side-by-side with one blank oriented one hundred eighty degrees from the other and the tabs are interdigitated. Thus, a strip of material corresponding to the height of the tabs above the side wall is saved compared to an arrangement where the tabs are symmetrically located on the side walls and the tabs on adjacent blanks abut each other.

Stacking and Interlocking The Boxes

Referring now to FIGS. 3 and 4 (which show the boxes from the rear), stacking and interlocking of the upper box 50 and the lower box 10 will now be described. As shown in FIG. 3, the upper box 50 is positioned above the lower box 10 and is offset to the right from vertical alignment of the boxes. In this position, the rear interlock tabs 40 and 42 are aligned with the rear interlock slots 106 and 108 and the front interlock tabs 36 and 38 are aligned with the rear interlock slots 102 and 104, respectively. With this alignment, the boxes are moved toward each other for inserting the interlock tabs into the corresponding slots. The front guide tabs 112 and 114 and the rear guide tabs 116 and 118 serve to pilot the boxes together in proper alignment for insertion of the tabs into the slots. The clearance notches 86 on the rear corner flaps make room for insertion of rear tabs 40 and 42. After the upper and lower boxes have been brought together with the tabs in the slots, the boxes are shifted relative to each other so that the hook portions of the tabs overlap the bottom panel of the upper box. During the manipulation of the upper and lower boxes the gates 35 prevent accidental opening of the corner interlocks 30. In the initial shifting movement, the notches underlying the hook portions of the tabs are occupied by the bottom panel of the box before the two boxes have reached vertical alignment. Additional shifting force causes the slits in the body portions of the tabs to be occupied by the bottom panel of the box whereby a friction fit is achieved to retain the boxes together.

CONCLUSION

Stackable boxes have been disclosed which are especially adapted for containing two pizza pies for delivery together. Upper and lower boxes are stacked in an interlocking relationship and the lower box may be constructed with an open top which is covered by the bottom of the upper box. A savings of material is achieved by this arrangement. The upper box may be provided with a hinged lid. The boxes are interlocked by upstanding tabs on the walls of the lower box which coact with slots in the bottom of the upper box. Positive interlock is achieved by hook-shaped tabs.

Although this invention has been described with reference to a particular embodiment, it is not to be construed in a limiting sense. Many variations and modifications will now occur to those skilled in the art. For a definition of the invention reference is made to the appended claims.

What is claimed is:

1. A pair of stackable boxes comprising, a lower box and an upper box, each box having a bottom and a plurality of upstanding walls including first and second parallel walls, the bottom of the upper box defining first and second slots disposed adjacent and parallel to the first and second walls, respectively, the first and second parallel walls of the lower box having first and second upstanding hook-shaped interlock tabs, respectively, the upper box being positioned on top of the lower box with the first and second upstanding hook-shaped interlock tabs of each of the first and second parallel walls in registry with and extending through the first and second slots, respectively, the upper box being positioned relative to the lower box such that the hook-shaped tabs overlap the bottom of the upper box, whereby the boxes are detachably interlocked and may be detached from each other by sliding the boxes relative to each other parallel to the first and second walls to a position in which the hook-shaped tabs do not overlap the bottom of the upper box.

2. A pair of stackable boxes as defined in claim 1 wherein:

said lower box has an open top.

3. A pair of stackable boxes as defined in claim 1 wherein:

the first and second parallel walls are front and rear walls, respectively, of each of said boxes, said upper box has a lid hingedly connected with the second wall.

4. A pair of stackable boxes as defined in claim 3 wherein, the bottom of the upper box defines third and fourth slots disposed adjacent and parallel to the first and second parallel walls thereof, respectively, and the first and second parallel walls of the lower box has third and fourth upstanding hook-shaped tabs, respectively, which are registerable with the third and fourth slots, respectively, with the upper box disposed over the lower box.

5. A pair of stackable boxes as defined in claim 4 wherein:

the bottoms of the lower and upper boxes are of substantially the same shape and size, all of said hook-shaped tabs are oriented in the same direction and are alignable and insertable into the respective slots only when the upper box is offset laterally in one direction from the lower box, whereby the boxes may be detachably interlocked by sliding the upper box in the other direction relative to the lower box.

6. A pair of stackable boxes as defined in claim 1 wherein:

the first and second parallel walls of the upper box include first and second index tabs, respectively, extending downwardly beyond the bottom of the upper box, said first index tab being an extension of the first wall and located opposite the first slot, said first slot being bounded on its outer edge by the first wall, and said second index tab being an extension of the second wall and located opposite the second slot, said second slot being bounded on its outer edge by the second wall.

7. A pair of stackable boxes as defined in claim 1 wherein:

each of said interlock tabs has a body portion connected with the respective wall and a hook portion separated by a notch from the wall and a slit extending into the body portion from the bottom of the notch.

8. A pair of stackable boxes as defined in claim 4 wherein:

the left upstanding hook-shaped tabs on the front and rear walls are located inwardly from the left end of the front and rear walls, respectively, by an offset distance which is greater than the width of the tabs, and the right hand upstanding hook-shaped tabs are offset inwardly from the right end of the front and rear walls, respectively, by a second offset distance which is greater than twice the width of the tabs.

9. In a box of the type having a panel with first and second adjacent angularly oriented edges and having first and second walls attached to and foldable at said first and second edges, respectively, towards an Upright position from the panel to form a corner, a corner interlock comprising:

a tab having a hook portion extending from the end of the first wall, said tab being coplanar with the first wall, the second wall having an opening including a first opening portion at a location which allows the tab to pass through the second wall with the tab substantially perpendicular to the second wall when the first wall is in a first folded position and when the second wall is folded toward the end of the first wall to a predetermined position in which the plane of the second wall is between the hook portion and the end of the first wall, said opening having a second opening portion which allows the first wall to be moved from the first folded position to a second folded position in which a portion of the second wall is disposed between the hook portion and an edge of the first wall when the second wall is in said predetermined position whereby the first wall is interlocked with the second wall by said tab, a gate member hingedly attached to the second wall and having a portion which is hingedly movable by said tab from a closed position in which it occupies a portion of the first opening portion to an open position when said tab extends through the second wall and the first wall is in the first folded position, said gate member being movable back to said closed position when said first wall is in the second position, said gate member being substantially perpendicular to the tab, whereby the edge of the gate member blocks movement of the tab from the second opening portion to the first opening portion.

* * * * *